US006405568B1

(12) United States Patent
Bellini

(10) Patent No.: US 6,405,568 B1
(45) Date of Patent: Jun. 18, 2002

(54) PLANT FOR PROCESSING YARN ON REELS

(75) Inventor: Giovanni Bellini, Milan (IT)

(73) Assignee: Loris Bellini S.p.A. (IT)

( * ) Notice: Subject to any disclaimer, the term of this patent is extended or adjusted under 35 U.S.C. 154(b) by 0 days.

(21) Appl. No.: 09/509,461

(22) PCT Filed: Sep. 23, 1998

(86) PCT No.: PCT/EP98/06054

§ 371 (c)(1),
(2), (4) Date: Mar. 28, 2000

(87) PCT Pub. No.: WO99/16953

PCT Pub. Date: Apr. 8, 1999

(30) Foreign Application Priority Data

Sep. 26, 1997 (IT) ..... MI97A2187
May 26, 1998 (IT) ..... MI980376 U

(51) Int. Cl.[7] ..... D06B 21/00; D06B 23/04
(52) U.S. Cl. ..... 68/10; 68/189; 68/210
(58) Field of Search ..... 68/10, 11, 189, 68/210

(56) References Cited

U.S. PATENT DOCUMENTS 2,736,184 A * 2/1956 Harvey, Jr. et al. ..... 68/189 X
3,344,622 A * 10/1967 Kronsbein ..... 68/10
4,172,704 A * 10/1979 Ohtake et al. ..... 68/210 X
4,341,361 A * 7/1982 Shaikh ..... 68/189 X
4,545,135 A * 10/1985 Barriquand et al. ..... 68/210 X
4,796,320 A * 1/1989 Ono ..... 68/10 X
4,992,016 A * 2/1991 Ferloni ..... 68/210 X
5,495,730 A * 3/1996 Meeker et al. ..... 68/10

FOREIGN PATENT DOCUMENTS

EP 0470562 * 2/1992
EP 0713936 * 5/1996
FR 2603620 * 3/1988
SU 460343 * 9/1975 ..... 68/210

* cited by examiner

*Primary Examiner*—Philip Coe
(74) *Attorney, Agent, or Firm*—Shlesinger, Fitzsimmons & Shlesinger

(57) ABSTRACT

A plant for dyeing and processing of yarns on reels comprising at least one processing station (11, 12, 13) with a processing device receiving reels stacked on vertical rods (25, 125). The processing device has an upper opening for loading and unloading the reels and the vertical rods are engaged in a removable manner in seats in said device. A rod-grasping unit (15, 115) is movable vertically and horizontally to be arranged above the opening in the processing device to grasp the rods (25, 125) and hoist them with the reels thereon out of the device or insert them in place in the device. In case of a plurality of stations passage between the stations is in this manner fully automatic.

22 Claims, 7 Drawing Sheets

PLANT FOR PROCESSING YARN ON REELS

Figure 1:
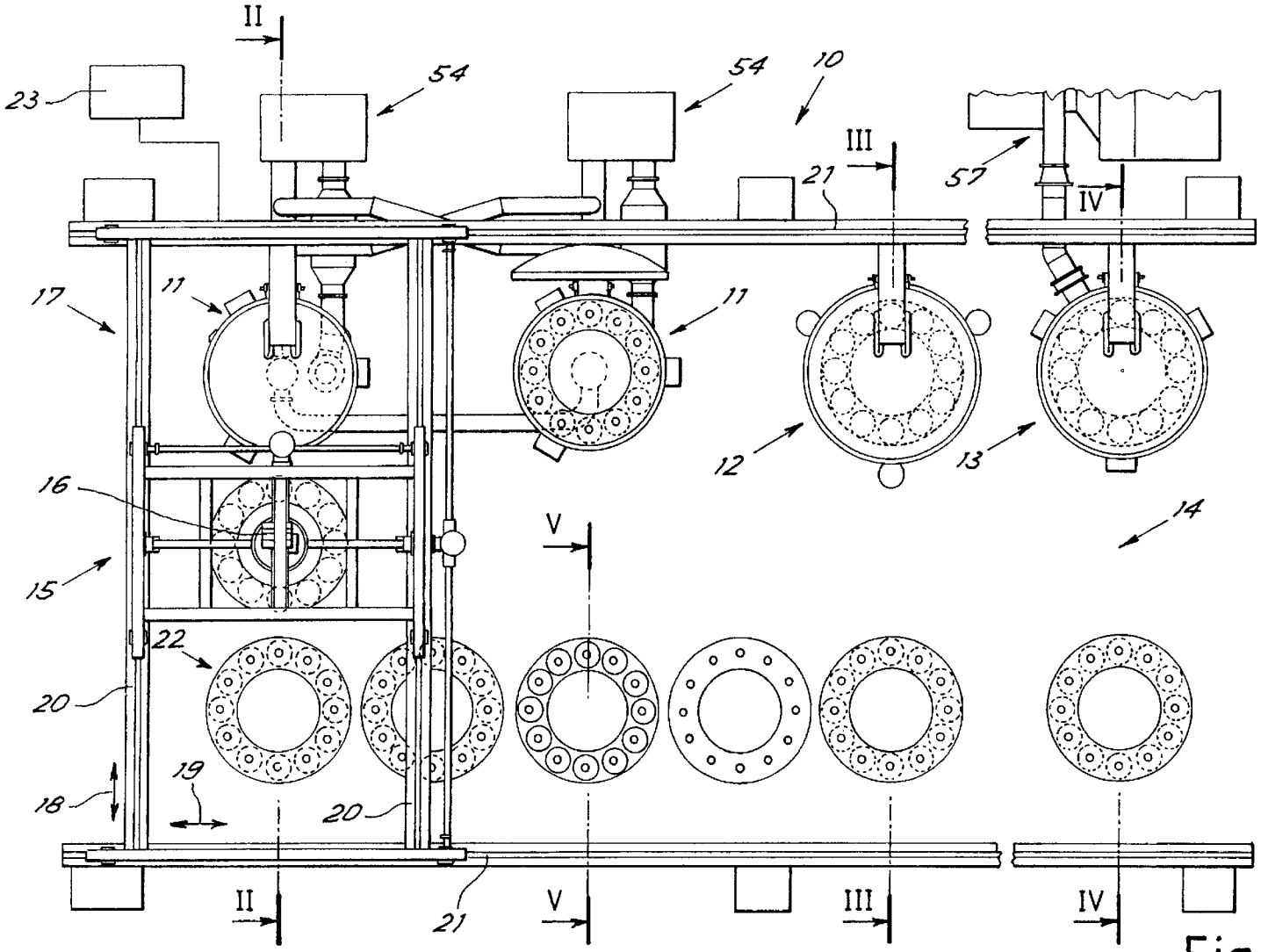

The present invention relates to a plant for processing reels of yarn and in particular dyeing.

In the prior art dyeing plants in which machines with vertical cylindrical containers receive the reels fitted on rods which are fastened to supports termed 'material holders' positioned in the containers are known. The operator must therefore fit the reels on the rods in the material holders, fit the material holder in the machine, start the dyeing cycle, at the end of the cycle remove the material holder, withdraw the reels from the material holder, move them into centrifuging machines and then drying machines. For each operation the reels must be removed from the supports of the preceding machine and positioned on the supports of the following machine. This involves time consumption and the inconvenience of having to handle the wet reels. In addition, personnel are necessary at each machine to perform all the loading and unloading operations.

Automatic handling plants have been proposed such as in EP-A-0713936. The complexity of such plants was however excessive with high risk of jamming and failure. In addition the space occupied by such plants was very great. Further plants have been proposed (see for example U.S. Pat. No. 4,341,361 and EP-A-0468566), wherein a reels loading device can be grasped as a whole to be moved between the processing stations.

The general purpose of the present invention is to obviate the above mentioned inconveniences by making available a plant for processing yarns on reels which would allow automatic reel handling with low complexity and limited space occupied and costs.

In view of said purpose it was sought to provide in accordance with the present invention a reeled yarn dyeing and processing plant comprising at least one processing station with a processing device receiving reels stacked on vertical rods characterized in that the device has an upper opening for loading and unloading the reels and the vertical rods are engaged in a removable manner in seats in said device with there also being a rod-grasping unit movable vertically and horizontally to be arranged above the opening in the processing device to grasp the rods and hoist them with the reels thereon out of the device or insert them in place in the device.

Figure 2:
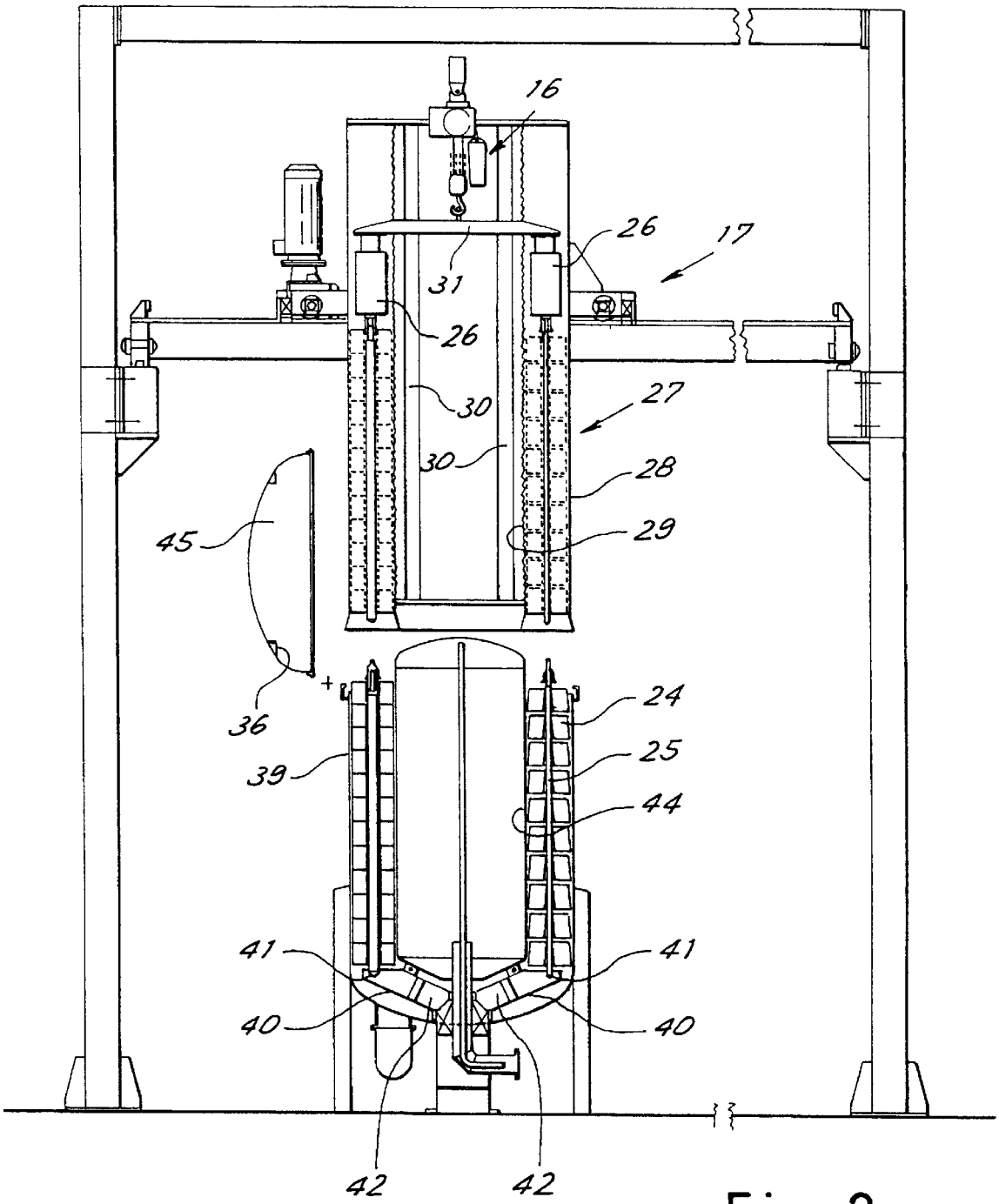
Figure 3:
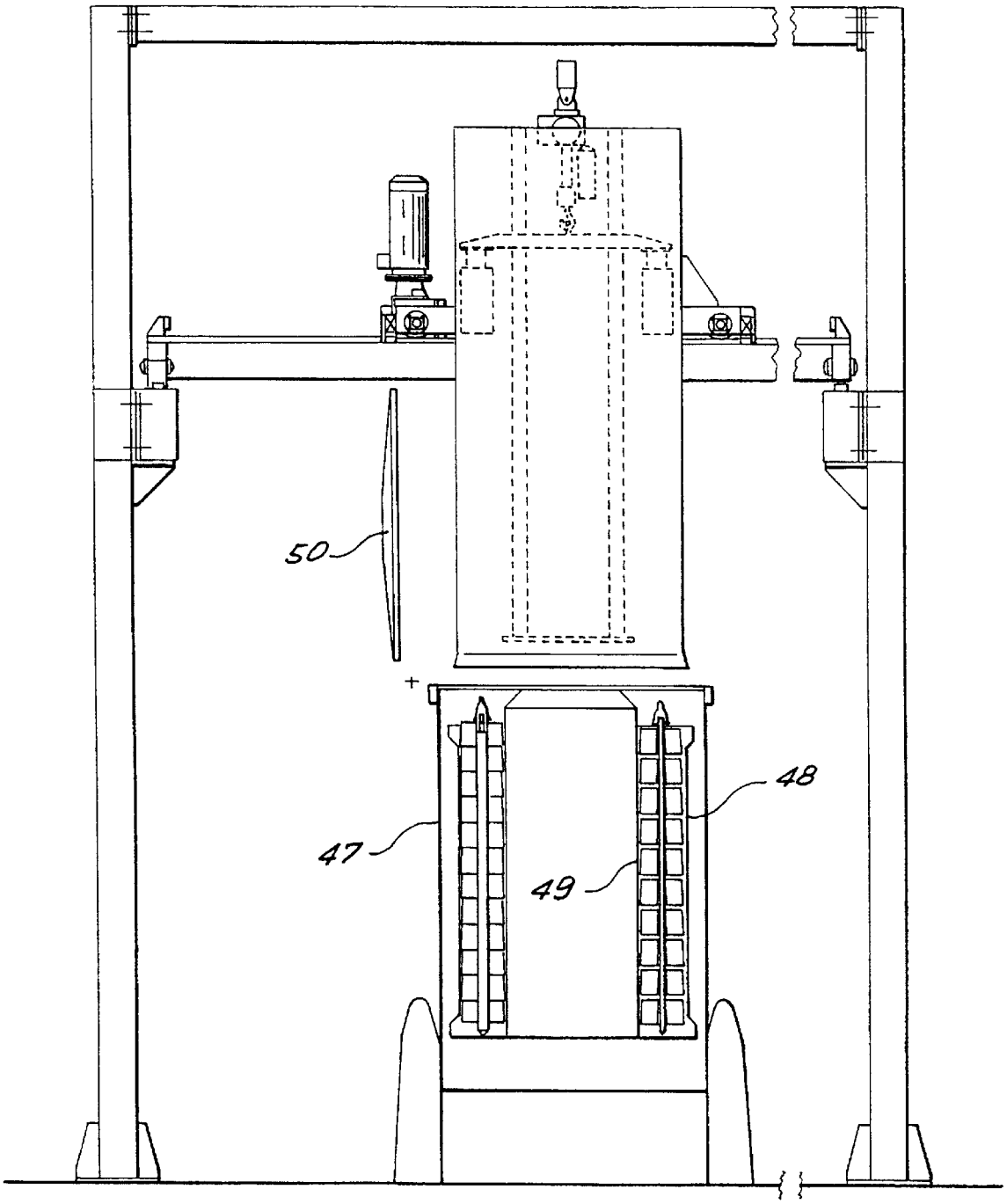
Figure 4:
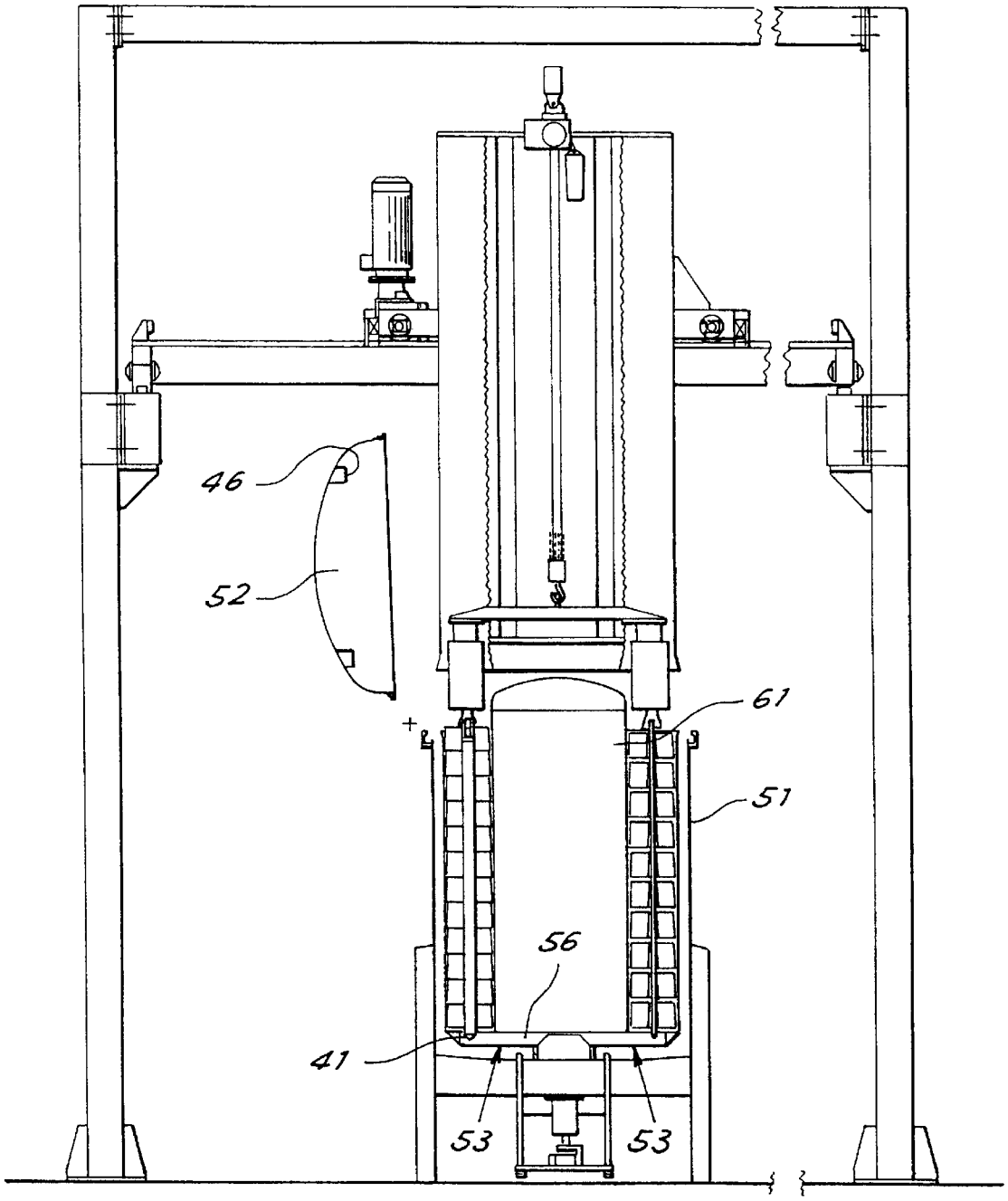
Figure 5:
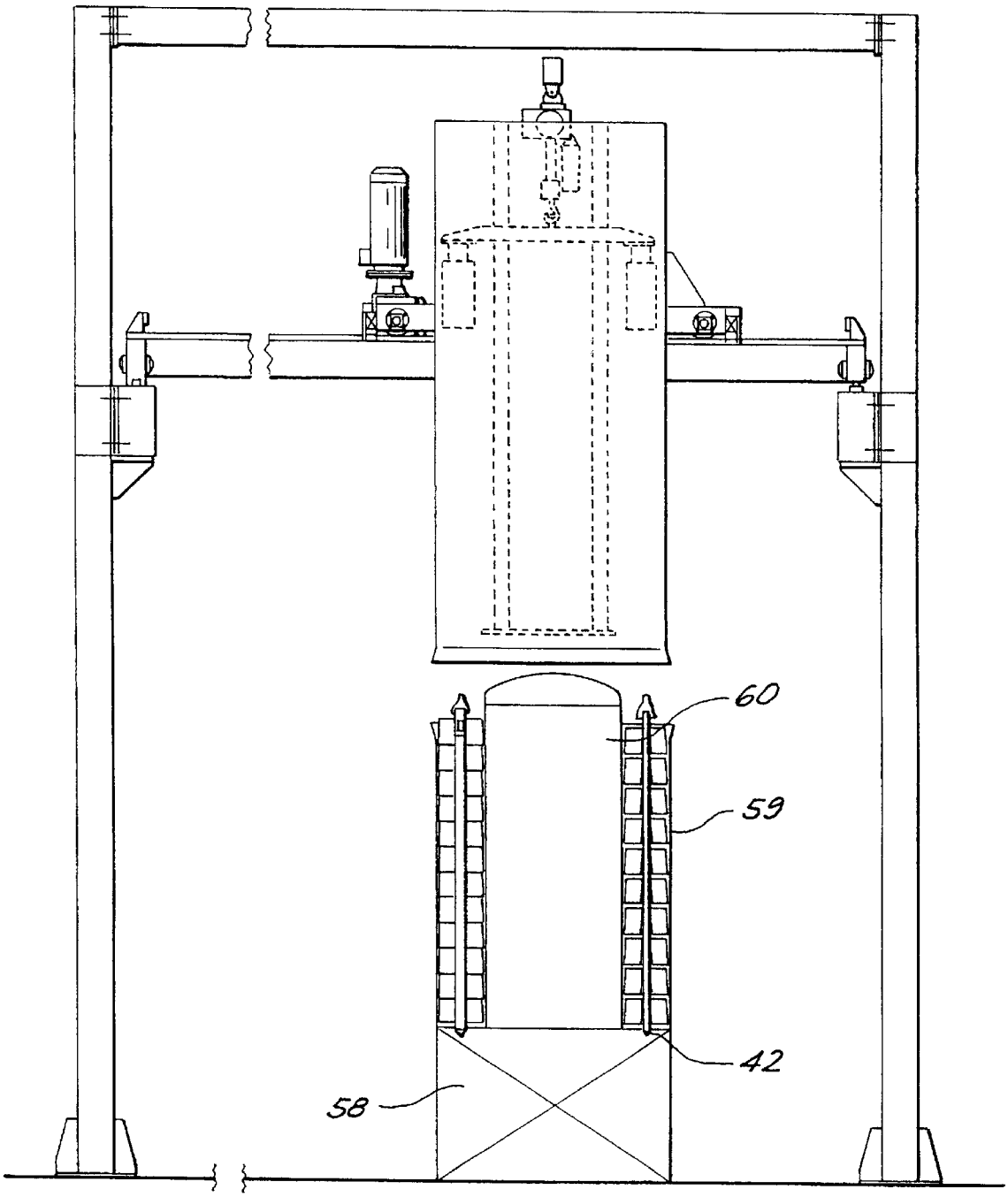
Figure 6:
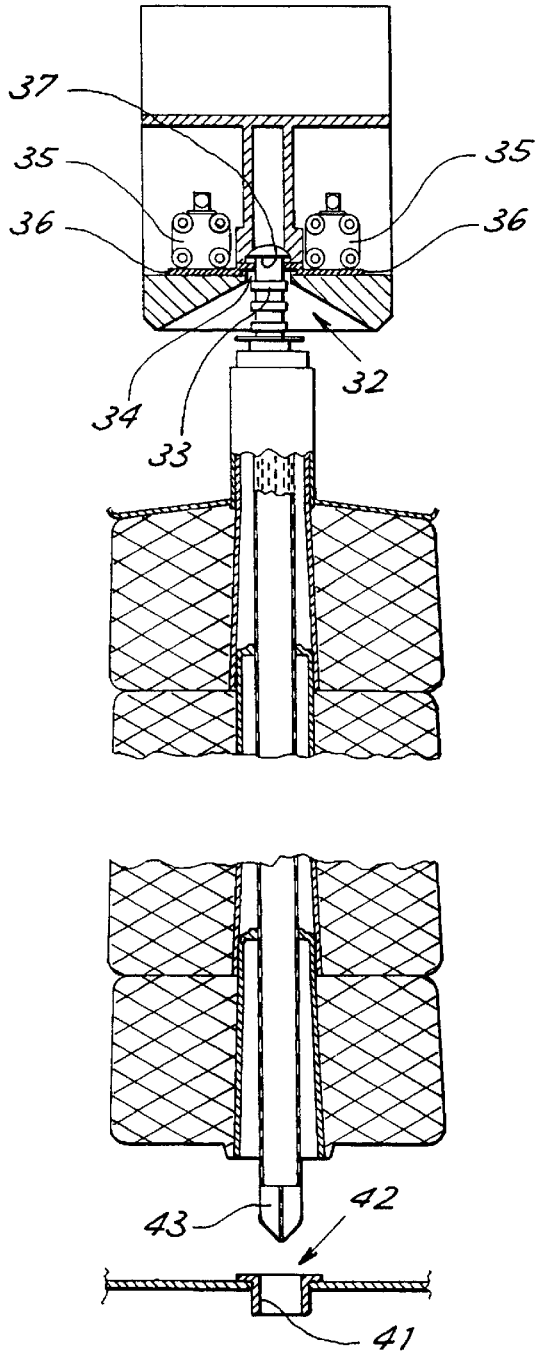
Figure 7:
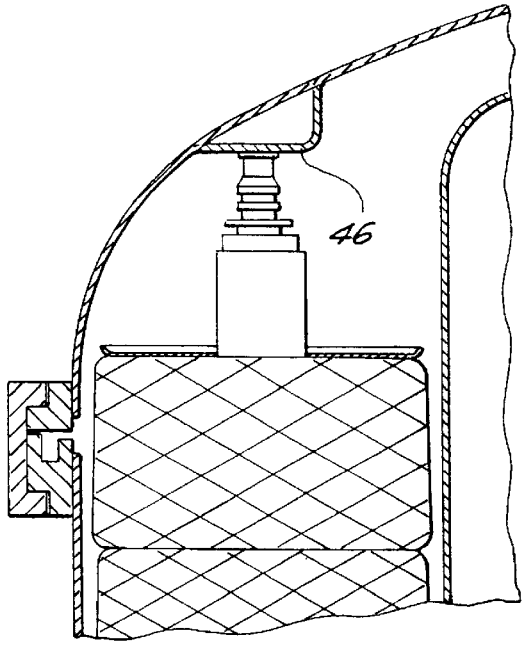
Figure 8:
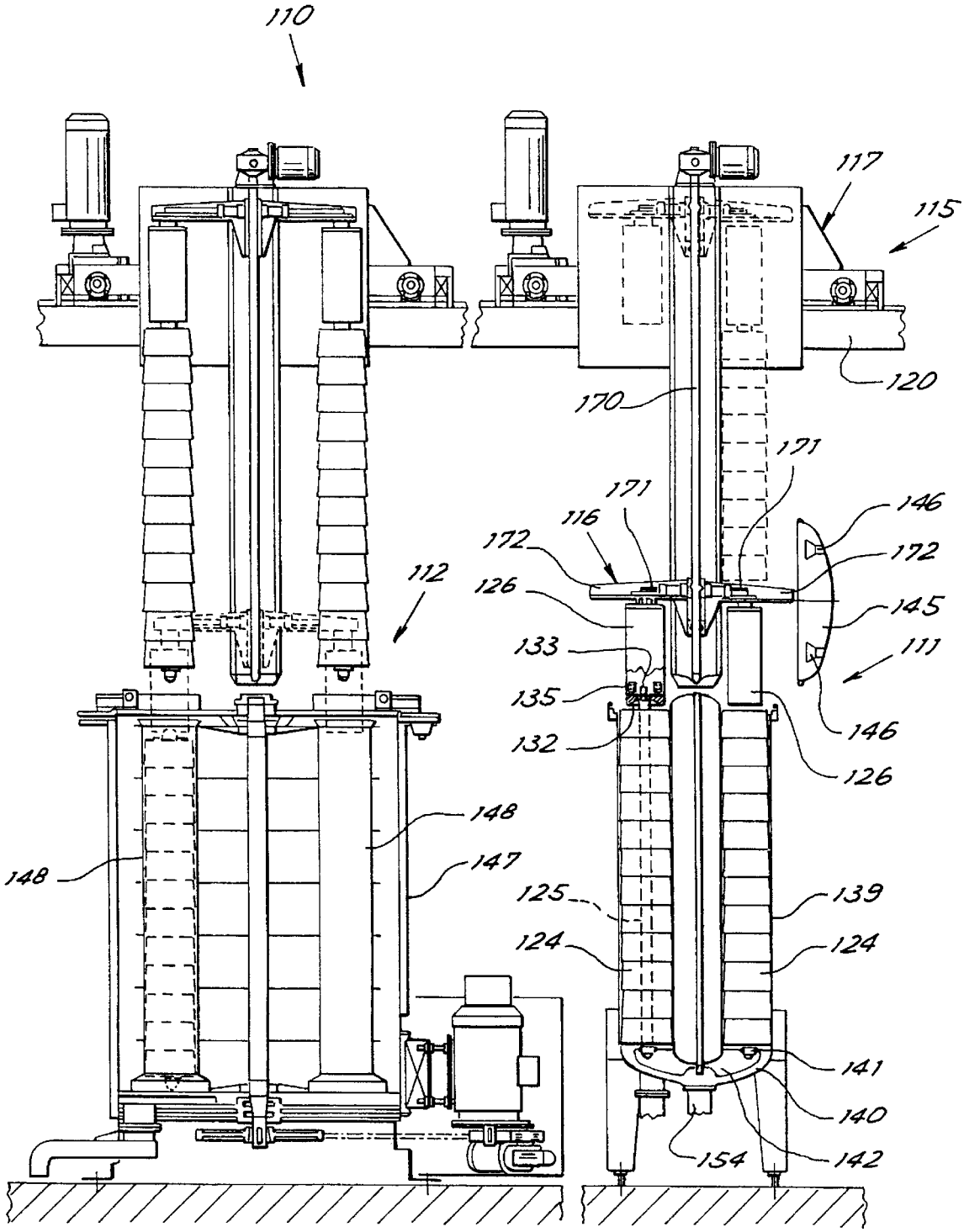

To clarify the explanation of the innovative principles of the present invention and its advantages compared with the prior art there are described below with the aid of the annexed drawings possible embodiments thereof by way of non-limiting example applying said principles. In the drawings:

FIG. 1 shows a partial diagrammatic plan view of a plant in accordance with the present invention, FIG. 2 shows a partial cross section view along plane of cut II—II of FIG. 1 with the plant in an operational phase, FIG. 3 shows a partial cross section view along plane of cut III—III of FIG. 1 with the plant in another operational phase, FIG. 4 shows a partial cross section view along plane of cut IV—IV of FIG. 1 with the plant in a third operational phase, FIG. 5 shows a partial cross section view along plane of cut V—V of FIG. 1 with the plant in a third operational phase, FIG. 6 shows a partial longitudinal cross section view of a reel-holding rod engaged by grasping means in accordance with the present invention, FIG. 7 shows a partial cross section view of a detail of a plant in accordance with the present invention, and FIG. 8 shows a cross sectioned front elevation view of an embodiment variant of the plant.

With reference to the figures, FIG. 1 shows a reeled yarn dyeing and treatment plant indicated as a whole by reference number 10. The plant comprises at least one processing station with a processing device receiving reels 24 stacked on vertical rods 25. For example in the figure are shown two dyeing stations 11, one centrifugation station 12, one drying station 13 and a plurality of holding or parking stations 14 which allow storage and support of the rods in the vertical position while waiting to be transferred to a subsequent work station.

As clarified below, each centrifugation, drying or parking station has an upper loading and unloading opening for the reels on the rods and has seats on which the vertical rods are engaged in a removable manner.

The plant also comprises a rod grasping unit 15 which is movable vertically and horizontally to be arranged above the opening in the processing device for grasping the rods and hoisting them with the reels thereon out of the device or inserting them in place in the device.

The unit 15 consists for example of a hoist 16 supported by a bridge crane 17 for horizontal handling in accordance with a first direction 18 (along rails 20) and a second direction 19 (along rails 21) which are mutually orthogonal.

The grasping and translation unit is thus movable between the devices of the stations to sequentially carry therein the rods with the reels loaded thereon. The reels can be loaded on the rods in an initial station 22 supporting the rods in the vertical position.

A control unit 23, for example a suitable processor appropriately programmed (essentially prior art and therefore not further shown or described) controls the cycle of operations performed by the plant.

FIG. 2 shows a cross section of the transfer unit 15 arranged above a dyeing device receiving reels to be dyed. As may be seen in said figure, the hoist 16 translated by the bridge crane 17 comprises a plurality of grasping members or clamps 26 arranged in accordance with a circumference for grasping the upper ends of the rods 25 which are similarly arranged in the various stations to be equally spaced along a circumference.

Advantageously the hoist runs inside a guide member 27 which guides the reels laterally during the vertical movement of the rods taken by the hoist. Oscillation of the reels during the vertical movement and horizontal translation is thus avoided. The guide member comprises a first external cylinder 28 and a second internal cylinder 29 which are mutually coaxial to identify a toroidal space within which run the grasping clamps. For this purpose the internal cylinder 29 has vertical slits 30 for passage of arms 31 supporting the clamps on the hoist. FIG. 2 shows the hoist fully raised. FIG. 4 shows it lowered in rod-grasping position in a treatment device.

FIG. 6 shows an example of a possible structure of one of the grasping clamps 26. This clamp comprises a lower tapered seat 32 facilitating entry of the end 33 of a rod 25. On the summit of the tapered seat is a housing 34 receiving the end of the rod. At the sides of the housing are actuators 35 for insertion therein of knives 36 which thus engage an edge 37 on the rod end. Upon descent of the clamps on the rods in a station the rod ends enter the seat 34 and are locked upon operation of the actuators 35 in such a manner that the hoist can raise the rods. The clamps are suspended from the hoist independently of one another so as to allow oscillating centering movement of the clamps on the rods.

Returning to FIG. 2 it shows a possible embodiment of a dyeing device with vertical axis. This device is made up of a container 39 with vertical axis and having a cover 45 for controlled closing. Near the bottom of the container are arranged supports 40 with the seats 41 for engagement in a removable manner of the lower ends of the rods. The ends of the rods and the seats have sealed means for connection of the interior of the rods, which are hollow, with dyeing liquid feed ducts 42 which are in the supports 40 and are in turn connected to liquid circulation means 54. As shown as an example in FIG. 6 the sealed connection means comprise in the support an engagement mouth 42 for sealed reception of the lower end 43 of the rod which is appropriately tapered to facilitate entry. The rods are pierced radially to allow inlet of the dyeing liquid in the reels.

To limit the quantity of dyeing liquid necessary and to avoid laterally guiding the reels during their insertion in the container 39 the device 11 has a reel reception chamber which is made toroidal thanks to an internal wall 44 coaxial with the wall of the cylindrical container 39. Operation of the dyeing machine is virtually prior art and not further described or shown.

FIG. 3 shows diagrammatically the centrifugation machine 12 loaded. The centrifugation device 12 comprises a container 47 with vertical axis and an internal side wall 48 and rotates with the stacks made up of the reels on the rods for support of the reels during their rotation around the container axis. A cover 50 closes the centrifuge upon command during operation. An internal cylindrical wall 49 rotating with the stacks provides a toroidal space for guiding and reception of the reels. Upon rotation of the centrifuge by motorized means not shown the reels lean laterally against the wall 48 and the liquid therein is removed without damaging the yarn.

FIG. 4 shows diagrammatically the drying device 13 which comprises a container 51 with vertical axis receiving the reels on the rods. A cover 52 closes the container on command. Near the bottom of the container are arranged supports 53 with seats 41 for removable engagement of the lower ends of the rods. As shown above in FIG. 6 the ends of the rods and the seats have means for connection of the interior of the rods to drying air feed ducts 56 located in the supports. A hot air circulation unit 57 feeds the drying air to the supports. An internal wall 61 constitutes a guide for the reels.

As may be seen in FIG. 7, advantageously both the dyeing machine 11 and the drying machine 13 have covers which when in closed position impede withdrawal of the lower ends of the rods from their respective seats thanks to an internal bead 46. This prevents the pressure of the dyeing liquid or the drying air from pushing the rods out of the lower seats.

FIG. 5 shows diagrammatically a holding station 14, 22. The station comprises a base 58 with seats 42 for engagement of the lower ends of the rods. The base is surrounded by a cylindrical wall 59 for containment and guiding of the reels on the rods engaged therein. Coaxial with and inside the cylindrical wall 59 is a second cylindrical wall 60 for providing a toroidal space for receiving the reels on the rods.

During operation of the plant the operator must manually or by mechanical means position the rods on the supports engaged in the initial holding station 22, fit the reels and lock them on the rods with the end plates.

Then the processing cycle is started. The hoist moves to a point vertically above the station 22, lowers and takes the rods with the reels fastened thereto. The grasping unit moves to the following work station, e.g. the dyeing station 11, and inserts the reels therein as shown in FIG. 2. Then the dyeing cycle is started at the end of which the dyeing apparatus opens and the hoist takes the reels to carry them to the following station, e.g. the holding station. The use of two dyeing apparatuses allows dyeing simultaneously two groups of reels, optimizing the relatively long dyeing times with the shorter centrifugation and drying times.

The dyed group is conveyed to the centrifugation station and then to the drying station to then be removed from the plant.

After each processing station the group of reels can if necessary be temporarily housed in an intermediate holding station so as to have a storage unit function to compensate for the differences in times of the various operations or temporary unforeseen events.

FIG. 8 shows an embodiment variant of the plant. Members similar to those of the above figures are indicated with the same numbers increased by 100.

With reference to FIG. 8 there is accordingly shown a diagrammatic cross section of a reeled-yarn dyeing and treatment plant indicated as a whole by reference number 110. The plant comprises at least two processing stations each with a processing device receiving reels 124 stacked on vertical rods 125. For example the figure shows a dyeing station 111 and a centrifugation station 112. Other stations, e.g. drying, holding, loading and unloading stations etc could be provided.

Each device has an upper loading and unloading opening and lower seats on which the vertical rods are engaged in a removable manner.

As an example the dyeing device is made up of a container 139 with vertical axis and a cover 145 with controlled closing. Near the bottom of the container are arranged supports 140 with seats 141 for engagement in a removable manner of the lower ends of the rods. The ends of the rods and the seats have sealed means for connection of the interior of the rods, which are hollow, with dyeing liquid feed ducts 142 which are in the supports 140 and are in turn connected to liquid circulation means 154. The rods are pierced radially to allow inlet of the dyeing liquid in the reels.

The cover 145 has internal projections 146 to prevent withdrawal of the lower ends of the rods from their seats when the cover is closed.

The centrifugation device 112 comprises a container 147 with vertical axis and tubular seats 148 for reception of the reels and rotating around the axis of the container by means of an appropriate motor.

Differently from the above embodiment the diameters of the two machines are different so that in the dyeing machine it is possible to reduce to a minimum the internal space not occupied by the reels while in the centrifuge a relatively large diameter is kept to optimize the centrifugal force acting on the reels. The angular arrangement of the rods in the stations is fixed while the radial distance from the central axis varies.

Over the stations is located a grasping and translation device or unit 115. The unit 115 is movable horizontally along rails 120 by means of a bridge crane 117 and comprises a hoist 116. In case of unaligned arrangement of the stations there may be provided movement of the unit 115 on orthogonal rails. In the figures the device is shown positioned over two different stations. In addition, it is shown to the right in lowered position and to the left in raised position. The opposing positions are shown in broken lines.

The grasping and translation unit is thus movable among the devices of the stations to sequentially carry into them the rods loaded with reels.

The hoist 116 translated by the bridge crane 117 comprises a plurality of grasping members or clamps 126 arranged in accordance with a circumference to grasp the upper ends of the rods 125. For the sake of simplicity the figure shows only two arms supporting one clamp each.

For its vertical movement the hoist can advantageously comprise a motorized screw 170.

Each clamp comprises a lower tapered seat 132 to facilitate entry of the end 133 of a rod 125 therein. Actuators 135 engage a circumferential cavity on the end of the rod.

The clamps are supported on the hoist by their own motorized carriages 171 running along radial guides 172 so as to be able to move radially and adapt to different diameters of the machines in the stations.

The transfer device can translate the clamps to carry each one to a point vertically over a stack of reels in a processing station. Radial movement of the clamps allows adapting their position to the diameter of the machine in the station. Vertical movement of the clamps allows taking the stacks from a station to set them in the machine in another station after adaptation of the radial position if necessary. All this can be performed automatically with no need for manual handling of the stacks or reels. It is now clear that the preset purposes have been achieved by supplying a plant allowing loading, unloading and moving of reels in and between different processing stations.

Naturally the above description of embodiments applying the innovative principles of the present invention is given by way of non-limiting example of said principles and therefore is not to be taken as a limitation of the scope of the exclusive right claimed here. For example, the stations could be of different number and type than those shown. A single dyeing station and/or no holding station could also be used depending on the times required by the specific utilization. In addition the bridge crane structures for transfer could be modified to adapt them to the particular requirements of the plant. The hoist could be the cable, chain, winch etc type.

What is claimed is:

1. A plant for dyeing and processing of yarns on reels, comprising a plurality of processing stations each with a processing device receiving reels stacked on vertical rods (25, 125) and having an upper opening for loading and unloading the reels, characterized in that the vertical rods (25, 125) are engaged in a removable manner in seats (41, 141) in said device and in that the plant comprises a rod-grasping unit (15, 115) movable vertically and horizontally between the stations of the plurality to be arranged above the opening in the processing device to grasp the rods and hoist them with the reels thereon out of the device and insert them in place in the device, the rod-grasping unit (15, 115) having clamping means (26, 126) to grasp the rods loaded with reels and move the rods from one station to the other.

2. Plant in accordance with claim 1 characterized in that the processing stations are at least three in number comprising a dyeing device (11, 111), a centrifugation device (12, 112) and a drying device (13) with the grasping unit (15, 115) being movable between the three devices to sequentially carry therein the rods with the reels stacked on them.

3. Plant in accordance with claim 1 characterized in that it comprises an additional initial station (22) for holding and support of the rods in vertical position for loading of reels thereon.

4. Plant in accordance with claim 3 characterized in that the holding station (22) comprises a base (58) with seats (42) for engagement of the lower ends of the rods with the base being surrounded by a cylindrical containment and guide wall (59) for reels on rods engaged therein.

5. Plant in accordance with claim 1 characterized in that between the processing stations are parking stations (14) for support of the rods in vertical position while awaiting transfer to a subsequent processing station.

6. Plant in accordance with claim 5 characterized in that the parking stations (14) comprise a base (58) with engagement seats (42) for the lower ends of the rods with the base being surrounded by a cylindrical containment and guide wall (59) for the reels on rods engaged therein.

7. Plant in accordance with claim 4 or 6 characterized in that coaxial with and internal to the cylindrical wall (59) is a second cylindrical wall (60) to provide a toroidal space for reception of the reels on the rods.

8. Plant in accordance with claim 1 characterized in that the processing station comprises a dyeing device (11, 111) comprising in turn a container with vertical axis near the bottom of which are arranged supports with the seats (41, 141) for removable engagement of the rod ends with the rod ends and seats having means (42, 142) for connection of the interior of the rods which are hollow with dyeing liquid feed ducts located in the supports.

9. Plant in accordance with claim 8 characterized in that the connection means comprise in the support an engagement mouth (42, 142) for sealed reception of the lower end of the rod.

10. Plant in accordance with claim 9 characterized in that the grasping unit (15, 115) comprises a hoist (16, 116) with clamps (26) arranged in accordance with a circumference for grasping the upper ends of the rods similarly arranged.

11. Plant in accordance with claim 10 characterized in that the hoist (16, 116) is supported by a bridge crane for horizontal movement.

12. Plant in accordance with claim 10 characterized in that the hoist (16) runs inside a guide member (28, 29) for the reels during vertical movement of the rods.

13. Plant in accordance with claim 12 characterized in that the guide member comprises a first (28) and a second (29) cylinder mutually coaxial for identifying a toroidal space within which run the grasping clamps (26) with the internal and external walls which define the toroidal space guiding the reels during the vertical movement of the rods grasped by the clamps.

14. Plant in accordance with claim 12 characterized in that the clamps (26, 126) are hung on the hoist (16, 116) mutually independently in an oscillating manner.

15. Plant in accordance with claim 8 characterized in that the device has a toroidal reel reception chamber and receives therein the reels equally spaced along the circumference.

16. Plant in accordance with claim 1 characterized in that the processing station comprises a drying device (13) comprising in turn a container with vertical axis near the bottom of which are arranged supports with the seats for removable engagement of the rod ends with the rod ends and seats having means for connection of the interior of the rods which are hollow with drying air feed ducts in the supports.

17. Plant in accordance with claim 1 characterized in that the processing station comprises a centrifugation device (12, 112) comprising in turn a container with rotating vertical axis with internal side wall for support of the reels on the rods during their rotation around the container axis.

18. Plant in accordance with claim 1 characterized in that the seats (41, 141) receive a lower end of the rods (25, 125) with the device having a closing cover (45, 52, 145) for the upper opening which in closed position impedes withdrawal of the lower ends of the rods from their seats.

19. Plant in accordance with claim 1 characterized in that the grasping unit (115) comprises rod-grasping clamps (126) which are movable to adapt to the different positions of the rods (125) in the particular processing device to grasp one rod each.

20. Plant in accordance with claim 19 characterized in that the clamps (126) are movable radially with respect to the others on command.

21. Plant in accordance with claim 20 characterized in that the clamps run radially with respect to the others along radial guides (172).

22. Plant in accordance with claim 1 characterized in that the grasping unit is vertically movable for less than a hoist (116) comprising a motorized vertical hoisting screw (170).

* * * * *